United States Patent [19]

Rodeghier

[11] 4,074,739

[45] Feb. 21, 1978

[54] GOLF CLUB AND GOLF ACCESSORY CARRIER

[76] Inventor: John H. Rodeghier, 255 S. Oak St., Orange, Calif. 92667

[21] Appl. No.: 769,316

[22] Filed: Feb. 17, 1977

[51] Int. Cl.[2] ..... A63B 55/00

[52] U.S. Cl. ..... 150/1.5 B; 211/60 G; 206/443; 224/45 R

[58] Field of Search ..... 224/45 R, 1 B, 5 C, 224/5 J, 21, 22, 23; 248/97, 98, 95; 206/443, 3; 280/DIG. 6, 1.5; 211/68, 60 G, 60 R, 60 SK; 150/1.5

[56] References Cited

U.S. PATENT DOCUMENTS

| | | | |
|---|---|---|---|
| 2,476,718 | 7/1949 | Foley | 280/DIG. 6 |
| 2,774,608 | 12/1956 | Sanders | 280/DIG. 6 |
| 3,081,108 | 3/1963 | Vogt | 280/DIG. 6 |
| 3,272,329 | 9/1966 | Mehalov | 206/443 |
| 3,272,371 | 9/1966 | Weiner | 206/443 |

FOREIGN PATENT DOCUMENTS

| | | | |
|---|---|---|---|
| 1,101,872 | 1/1968 | United Kingdom | 280/DIG. 6 |
| 692,700 | 6/1953 | United Kingdom | 280/DIG. 6 |
| 917,877 | 2/1963 | United Kingdom | 280/DIG. 6 |

*Primary Examiner*—Dryaton E. Hoffman
*Assistant Examiner*—Donald W. Underwood
*Attorney, Agent, or Firm*—William C. Babcock

[57] ABSTRACT

A golf club and golf accessory carrier defined by first and second longitudinally corrugated elongate panels that are bonded back to back. The first and second panels when so bonded provide a number of elongate spaced cavities that removably support the shaft of the golf club, and the bonded panels also cooperating to provide a confined space in which golf balls may be stored, elongate spaces that removably engage the shanks of a number of tees, and a flat support on which a score pad is removably mounted. A pair of legs is pivotally supported on the carrier, with the legs in a first position extending longitudinally thereto, and the legs in a second position extending downwardly and outwardly at an angle from the carrier, to support the carrier in an elevated position when an end portion of the carrier rests on the ground. The bonded panels also cooperate to provide a handle for carrying the carrier, which carrier is particularly adapted for use on par-three golf courses.

5 Claims, 5 Drawing Figures

FIG. 1
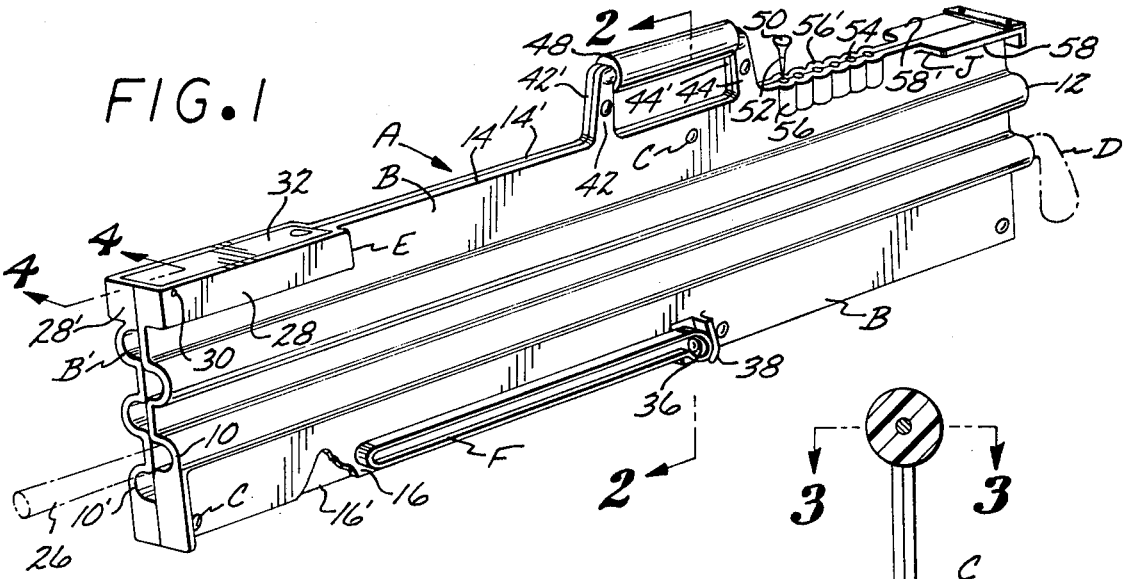
FIG. 3
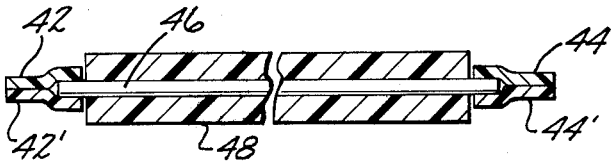
FIG. 4
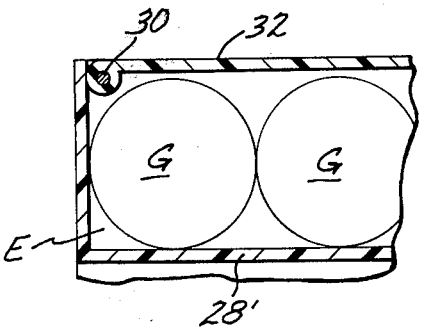
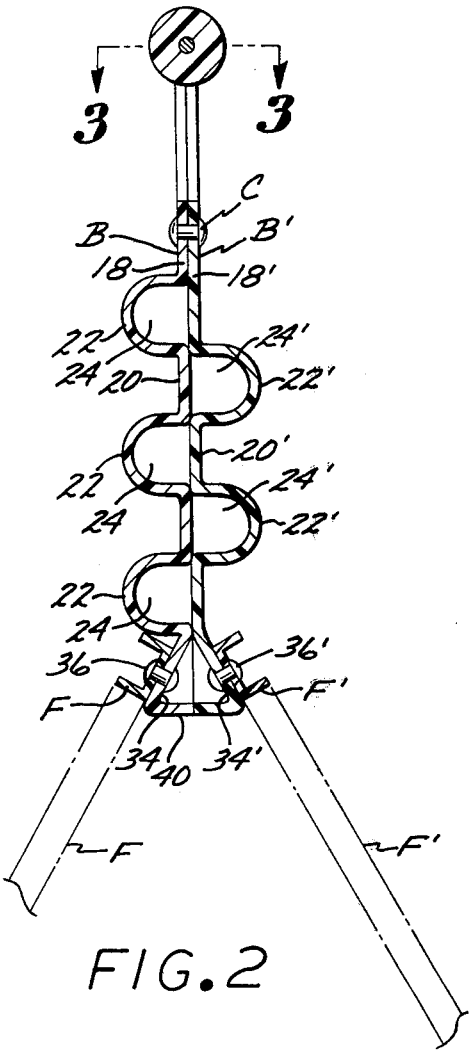
FIG. 2
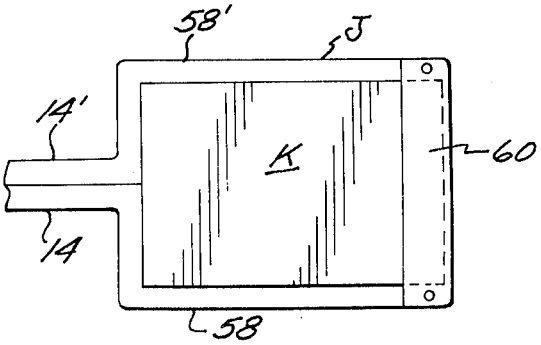
FIG. 5

GOLF CLUB AND GOLF ACCESSORY CARRIER

BACKGROUND OF THE INVENTION

1. Field of the Invention

Golf Club and Golf Accessory Carrier.

2. Description of the Prior Art

A golfer on a regulation course will normally carry a bag in which a number of irons and woods are carried, as well as a number of golf balls. On a par-three golf course, the woods are not required, nor are many of the irons that are used on a regulation golf course.

A primary purpose in devising the present invention is to provide a compact, light-weight carrier for a limited number of golf clubs, as well as a supply of golf balls, tees, and a support on which a score pad is removably mounted. The carrier includes a handle to permit the carrier to be transported over a par-three golf course in substantially horizontal position. The carrier also includes a pair of legs pivotally mounted thereon, with the legs in a first position being substantially parallel to the carrier and adjacent a side edge thereof, but with the legs when in a second position extending downwardly from the carrier and outwardly at an angle relative thereto, to permit the carrier to be disposed in an elevated position above the ground surface when an end portion of the carrier rests thereon. The carrier is of such structure that, with the extension of the fastening hardware, the entire carrier may be molded from an expanded commercially available plastic material.

SUMMARY OF THE INVENTION

A pair of first and second substantially rectangular, longitudinally corrugated panels are bonded together back-to-back, and the panels when so bonded cooperating to define a handle for transporting the carrier in a horizontal position and also cooperating to provide a number of longitudinally extending cavities in which the shanks of golf clubs are removably disposed, a confined space for storing a number of golf balls, a number of elongate spaces in which the shanks of tees may be removably disposed to support the tees on the carrier, and a flat support on which the scorepad is removably mounted. The carrier intermediate the ends thereof pivotally supports a pair of legs, which legs in a first position are longitudinally disposed adjacent the carrier, and in a second position extend outwardly from the carrier. The legs when in the second position cooperate with an end portion of the carrier, to support the carrier in an elevated position above the ground on which the free extremities of the legs rest as does one end of the carrier. The carrier above-described is of such structure that it, with the exception of the fastening hardware, may be molded from an expandable plastic material of a type that is commercially available.

BRIEF DESCRIPTION OF THE DRAWING

FIG. 1 is a perspective view of the golf club carrier, with the pair of legs movably supported therefrom disposed in a first position, and a golf club illustrated in phantom line supported within a longitudinally extending cavity defined in the carrier;

FIG. 2 is a transverse cross sectional view of the carrier shown in FIG. 1 taken on the line 2—2 thereof that with the legs disposed in a second position;

FIG. 3 is a fragmentary transverse cross sectional view of the device taken on the line 3—3 of FIG. 2;

FIG 4. is a fragmentary longitudinal cross sectional view of the device taken on the line 4—4 of FIG. 1; and FIG. 5 is a fragmentary top plan view of an upper end portion of the device illustrating a support formed thereon and on which a score pad may be removably mounted.

DESCRIPTION OF THE PREFERRED EMBODIMENT

The golf club and golf accessory carrier A as may best be seen in FIG. 1 includes first and second generally rectangular panels B and B' that are held together in abutting contact by a number of conventional fasteners C such as screws, rivets or the like. The first and second panels B and B' have first end edges 10 and 10' and second end edges 12. The panels B and B' also include first side edges 14 and 14' as well as second side edges 16 and 16'.

First and second panels B and B' have first side surfaces 18 and 18' that are in abutting contact as may best be seen in FIG. 2. The first and second panels B and B' also include second side surfaces 20 and 20' that are exteriorly disposed and the second side surfaces having a number of first and second longitudinally extending laterally spaced corrugations 22 and 22' defined thereon. The first and second corrugations 22 and 22' cooperate with portions of the panels oppositely disposed therefrom to define a number of longitudinally extending laterally spaced cavities 24 and 24' in which the shanks 26 of golf clubs D may be removably disposed for carrying purposes as shown in FIG. 1.

The first and second panels B and B' adjacent the first side edges 14 and 14' have outwardly and oppositely extending projections 28 and 28' of such shape as to cooperate to define a longitudinally extending open top box E as best seen in FIG. 1 in which excess golf balls G may be stored. A transverse pin 30 extends between projections 28 and 28' and pivotally supports a cover 32 that may be disposed to close the upper open end of box E. Cover 32 is held in a closing position by conventional fastening means (not shown).

First and second panels B and B' intermediate the first and second ends thereof and adjacent the second side edges 16, 16' have first and second walls 34, 34' extending downwardly and outwardly in opposite directions as viewed in FIG. 2. First and second walls 34, 34' have first and second rivets 36, 36' extending transversely therethrough, which rivets serve to pivotally support first and second legs F and F'.

The first and second legs F and F' may be disposed in longitudinally extending first positions as shown in FIG. 1, or in second positions as shown in phantom line in FIG. 2. When first and second legs F and F' occupy the second position and first ends 10, 10' at least partially rest on the ground surface, the carrier is angularly disposed relative to the ground surface to permit the easy removal of a desired golf club D therefrom. Identical stops 38 project from walls 34, 34' to prevent first and second legs F and F' pivoting beyond positions normal to the second side edges 16, 16'. First and second walls 34, 34' are preferably connected by a transverse reinforcing web 40 as shown in FIG. 2.

Two longitudinally spaced pairs of legs 42, 42' and 44, 44' extend outwardly from the side edges 14, 14' of first and second panels B and B', preferably at substantially the center thereof, with the legs so shaped as to support a longitudinal rod 46 therebetween on which a cylindrical handle 48 is mounted.

A number of tees 50, one of which is shown in phantom line in FIG. 1, can be removably supported on the carrier A by having the shanks 52 of the tees frictionally engage elongate openings 54 defined between oppositely disposed recessed portions 56, 56' on the first and second panels B, B'.

First and second flat supports 58, 58' extend outwardly in opposite directions from the first and second side edges 14, 14' as shown in FIG. 1, and cooperate to provide a mounting J on which a score pad K rests. The pad K may be held on mounting J by a conventional clip 60 or other suitable fastening means. First and second panels B and B' preferably have flanges 62, 62' on the first ends thereof that at least partially rest on the ground surface when the carrier A is supported on the latter by first and second legs F and F'.

The carrier A is sued in the same manner as a conventional golf bag, and normally will be carried by a user in a substantially horizontal position by the user grasping the handle 48.

The use and operation of the invention has been described previously in detail and need not be repeated.

I claim:

1. A carrier for golf clubs and golf accessories for use on a par-three golf course, said carrier including:

a. first and second equally sized elongate panels only, each of said panels having first and second end edges, and first and second side surfaces, said first side surfaces being at least partially flat and in abutting contact, said second surfaces at least partially defined by a plurality of longitudinal, laterally spaced corrugations, and each of said corrugations cooperating with a part of said flat side surface oppositely disposed thereto to define an elongate cavity in which one of said golf club shafts may be removably disposed, with said cavities laterally offset from one another to removably support said golf clubs in offset positions from one another;

b. first means for holding said first and second panels and at least portions of said first side surfaces thereof in abutting contact;

c. second means that are laterally aligned and project outwardly in opposite directions from portions of said first side surfaces and formed integral with said first and second panels, said second means cooperating to define an elongate box in which a plurality of golf balls may be carried;

d. third means for removably closing said box to maintain said golf balls therein;

e. first and second laterally aligned legs pivotally supported from said first and second panels intermediate said first and second end edges thereof, said legs when in a first position extending longitudinally relative to said first and second panels and adjacent thereto, said first and second legs when in a second position extending outwardly from said first and second panels in angularly disposed positions to support said carrier above the ground surface when said first end edges rest on the latter; and f. fourth means extending outwardly from said first and second panels that cooperate to define a handle for carrying said carrier.

2. A carrier as defined in claim 1 which in addition includes:

g. fifth means extending outwardly from said first and second panels that cooperate to define a plurality of elongate spaces that frictionally engage the shanks of a plurality of tees to removably support said tees on said carrier.

3. A carrier as defined in claim 1 which in addition includes:

h. a pad of paper for keeping score;

i. sixth means extending outwardly from said first and second panels that cooperate to provide a flat support on which said pad of paper may be mounted; and j. sixth means for removably maintaining said pad of paper on said support.

4. A carrier as defined in claim 1 in which said third means is a cover, and said carrier in addition including:

g. a transverse shaft supported by said box, and said shaft pivotally supporting said cover to permit said cover to be disposed in either an open or closed position.

5. A carrier as defined in claim 1 which in addition includes:

g. a pair of first and second stops that extend outwardly from said first and second panels, said first and second stops so disposed as to prevent said first and second legs pivoting beyond normal positions relative to said first and second panels.

* * * * *